United States Patent [19]

Mardikian

[11] Patent Number: 4,932,347

[45] Date of Patent: Jun. 12, 1990

[54] JET SKI HULL

[75] Inventor: Albert A. Mardikian, Corona Del Mar, Calif.

[73] Assignee: American Hydro Ski, Inc., Huntington Beach, Calif.

[21] Appl. No.: 230,138

[22] Filed: Aug. 9, 1988

[51] Int. Cl.[5] ..... B63B 1/04

[52] U.S. Cl. ..... 114/56; 114/270; 114/290

[58] Field of Search ..... 114/270, 56, 290; D12/307

[56] References Cited

U.S. PATENT DOCUMENTS

| | | | |
|---|---|---|---|
| D.286,629 | 11/1986 | Suzuki et al. | D12/307 |
| D.287,846 | 1/1987 | Nishida | D12/307 |
| 3,148,652 | 9/1964 | Canazzi | 114/56 |
| 3,827,392 | 8/1974 | Jones | 114/270 |
| 3,930,455 | 1/1976 | Bremer | 114/290 |
| 3,982,497 | 9/1976 | Caron | 114/270 |
| 4,004,542 | 1/1977 | Holmes | 114/56 |
| 4,492,176 | 1/1985 | Arima | 114/56 |

FOREIGN PATENT DOCUMENTS

| | | | |
|---|---|---|---|
| 62-4686 | 1/1987 | Japan | 114/270 |
| 2027643 | 2/1980 | United Kingdom | 114/288 |

OTHER PUBLICATIONS

Caliber Boats advertisement received PTO 6/20/77.

*Primary Examiner*—Sherman D. Basinger
*Assistant Examiner*—Thomas J. Brahan
*Attorney, Agent, or Firm*—Jackson & Jones

[57] ABSTRACT

A jet ski hull includes upper and lower sections joined along a peripheral edge which edge is arranged to extend above the nominal waterline. In accordance with the present intention the lower hull section comprises (1) a central section extending from the bow of the ski to the stern thereof, 2) a concave section disposed on each side of the central section, (3) a pair of side walls joined to the upper hull section of the peripheral edge and extending downwardly and inwardly from the peripheral edge and (4) a transition section joining the lower portion of each side wall to a respective concave section. Each concave section defines a channel extending substantially the length of the hull for channeling water therethrough to prevent the hull from skidding during turns.

19 Claims, 3 Drawing Sheets

JET SKI HULL

BACKGROUND OF THE INVENTION

1. Field of the Invention

The present invention relates to jet ski hulls and more particularly to an improvement in the bottom section of such a hull.

2. Description of the Prior Art

Over the past two decades personal watercraft commonly referred to as jet skis and utilizing a jet pump for propulsion have become very popular. The hull of such jet skis includes an upper section and a lower section joined along a peripheral edge which extends from the bow to the stern. The upper section generally includes a flat body supporting portion extending forwardly the stern for supporting a rider and a handle pivotally mounted adjacent the bow and extending rearwardly to be grasped by the rider for balance and control purposes.

The lower section of the hull of the prior art jet skis is arranged to ride in the water and conventionally has a pair of side walls extending vertically downwardly from the peripheral edge and a central portion extending between the side walls. The central portion in the prior art jet skis is generally in the form of a slightly contoured convex surface.

The central portion of the lower hull section is provided with a ride plate that extends below the pump. The pump receives water through a water inlet opening forward of the ride plate and exhausts the water at high velocity from a water outlet opening in the stern.

While the prior art jet skis are quite maneuverable they have several shortcomings. First, such jet skis are generally unstable at low speeds requiring most riders to kneel or sit on the body supporting portion until the jet ski has reached a high speed of the order of 15 miles per hour.

Second, such prior art jet skis tend to skid when cornering thereby making high speed sharp turns difficult for all but the most highly skilled riders.

Third, such jet skis have blunt bow section which tends to push water over the bow and onto the rider. These shortcomings are overcome by the present invention which is directed to any improved lower hull section for a jet ski.

The nature and operation of this invention, as well as the advantages thereof with respect to the prior art, will become readily apparent in light of the following description taken in conjunction with the annexed drawings in which like reference numerals designate like parts throughout the figures thereof.

SUMMARY OF THE INVENTION

A jet ski hull includes upper and lower sections joined along a peripheral edge which edge is arranged to extend above the nominal water line. In accordance with the present invention the lower hull section comprises (1) a central section extending from the bow of the ski to the stern thereof, (2) a concave section disposed on each side of the central section, (3) a pair of side walls joined to the upper hull section of the peripheral edge and extending downwardly and inwardly from the peripheral edge and (4) a transition section joining the lower portion of each side wall to a respective concave section. Each concave section defines a channel extending substantially the length of the hull for channeling water therethrough to prevent the hull from skidding during turns.

DETAILED DESCRIPTION OF THE ILLUSTRATED EMBODIMENT

Figure 1:
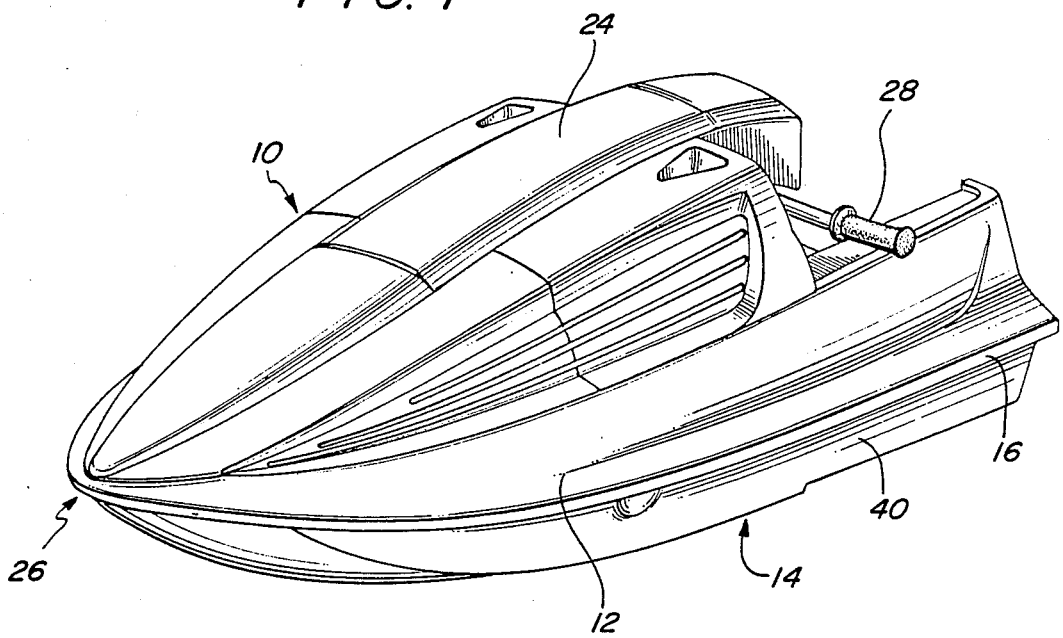
FIG. 1 is a perspective view of a jet ski hull in accordance with the invention.
Figure 2:
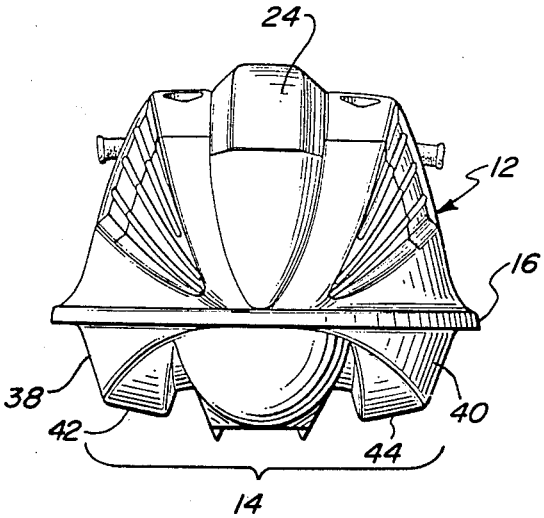
FIG. 2 is a front view of the jet ski of FIG. 1 showing the bow thereof.
Figure 3:
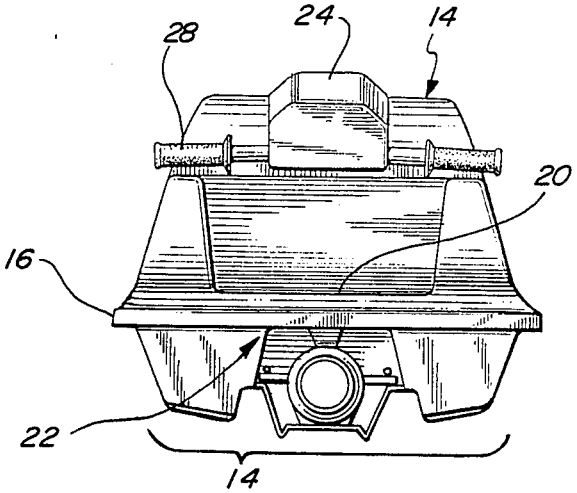
FIG. 3 is a rear view of the jet ski of FIG. 1 showing the stern thereof.
Figure 4:
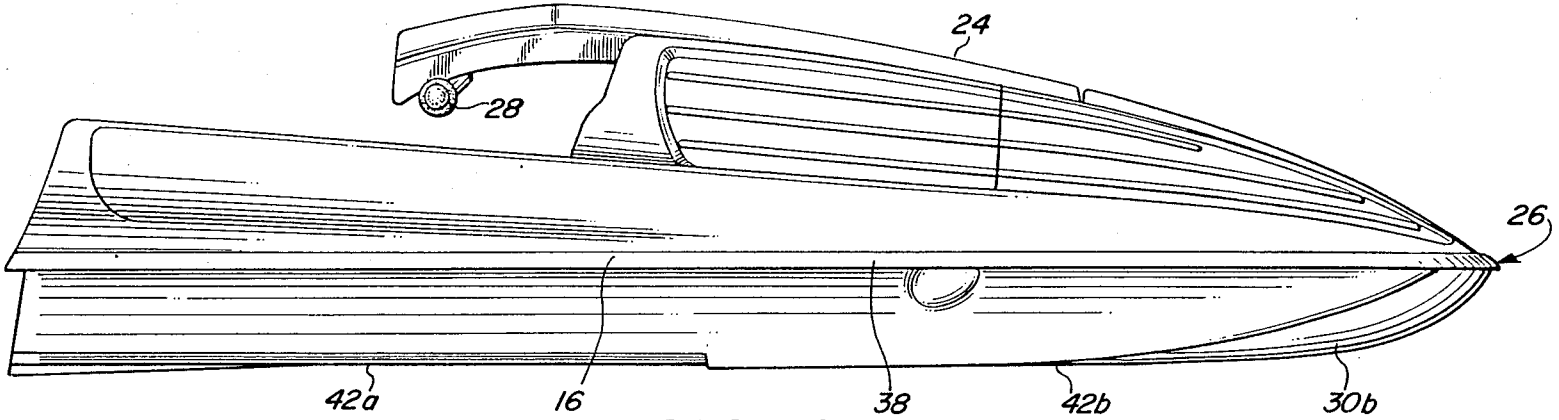
FIG. 4 is a side elevational view of the jet ski of FIG. 1.
Figure 5:
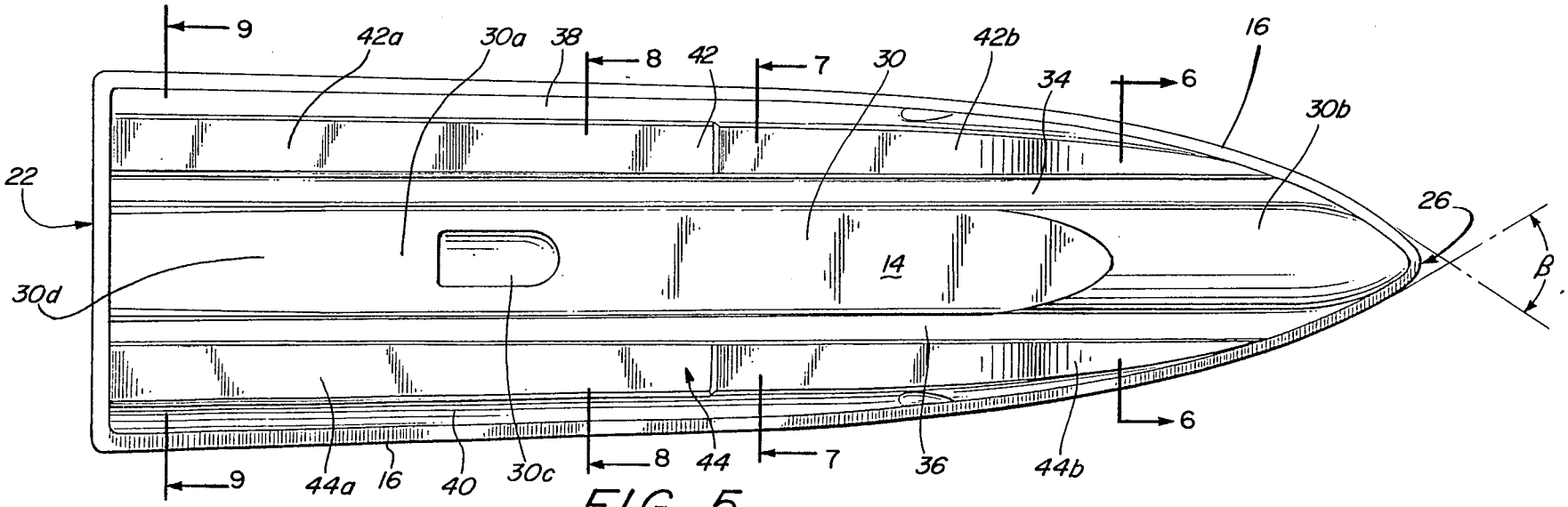
FIG. 5 is a bottom plan view showing the lower hull section of the jet ski of FIG. 1.
Figure 7:
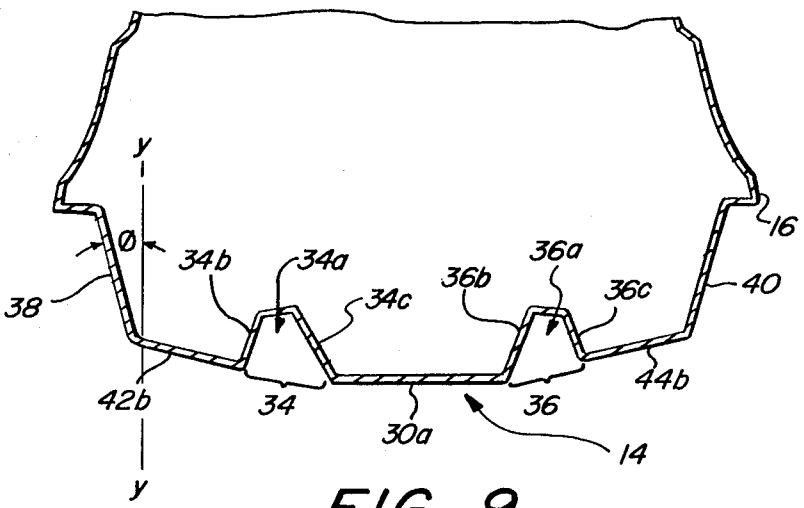
FIG. 7 is a cross sectional view taken along line 7—7 of FIG. 5.

Referring now to the drawings and particularly to FIGS. 1–4, the jet ski hull 10 includes a upper section 12 and a lower section 14 which join along a peripheral edge 16. The upper hull section includes a flat body supporting portion 20 extending from the stern 22 forwardly approximately one-third the length of the hull. A handle bar member 24 is pivotally mounted near the bow 26 and includes a pair of hand grips 28 arranged to be grasped by the rider for balance and control purposes as is well known in the art. The peripheral edge 16 forms a relatively sharp angle B of about 45 degrees at the bow as is shown in FIG. 5. This sharp bow section aids in preventing water from being forced over the bow and onto the rider at high speeds.

Referring now to FIGS. 5–9, the lower hull section 14 includes a central section 30 which comprises a flat portion **30*a* extending approximately three-fourths of the length of the hull starting at the stern 22 and a semi-cylindrical portion 30*b* extending from the flat portion 30*a* to the bow 26** as illustrated.

The flat portion **30*a* of the central section of the lower hull defines a water inlet opening 30*c* through which water is directed to the intake of a jet pump (not shown) housed within the hull. A ride plate 30*d* extends aft of the water inlet 30*c* and forms the aft end of the flat portion 30*a* of the central hull section 30. The jet pump is positioned above the ride plate 30*d***.

A pair of concave sections 34 and 36 join the central section 30 and extend substantially from the bow 26 to the stern 22. As shown, each concave section defines a channel for channeling water therethrough to reduce the tendency of the hull to skid during sharp turns and cornering.

A pair of side walls 38 and 40 join the upper section 12 at the peripheral edge 16 and extend from the bow 26 to the stern 22. The side walls 38 and 40 extend downwardly and inwardly toward the central section 30 and form an acute angle with a vertical plane y—y (FIGS. 6—9) passing through the peripheral edge. This angle, designated $\phi$ adjacent the stern is within the range of 10 degrees to 30 degrees and preferably about 20 degrees. This angle generally increases from the bow to the stern as illustrated.

A pair of transition sections 42 and 44 join the side walls 38 and 40 to the concave sections 34 and 36, respectively. The transition sections are flat and step upwardly approximately one- half of the way between the bow and stern so that the rear positions 42*a* and 44*a* of the transition sections adjacent the stern are in a plane above the plane of the front portions 42*b* and 44*b*. See FIGS. 4 and 5. As shown in FIGS. 6–9, the transition sections 42 and 44 slope downwardly and inwardly from the lower edge of the side walls 38 and 40 toward the central sections, the transition sections 42 and 44 form an angle $\xi$ with a vertical plane y—y passing through the lower edge of the respective side walls adjacent the stern. The angle $\xi$ is preferably within the range of about 60 degrees to 80 degrees. See FIG. 9. The angle $\xi$ is most preferably about 75 degrees.

Figure 9:
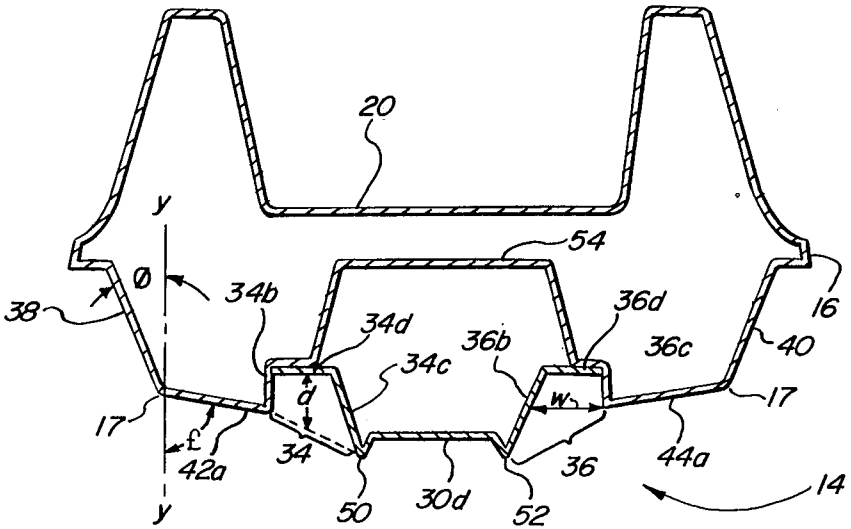
FIG. 9 is a cross sectional view taken along lines 9—9 of FIG. 5.
Figure 6:
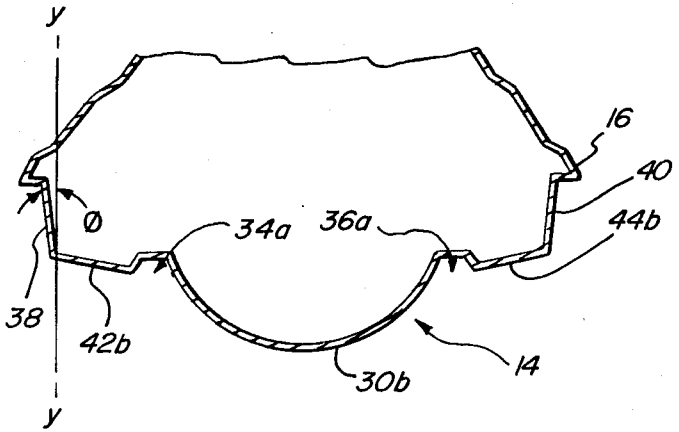
FIG. 6 is a cross sectional view taken along lines 6—6 of FIG. 5.
Figure 8:
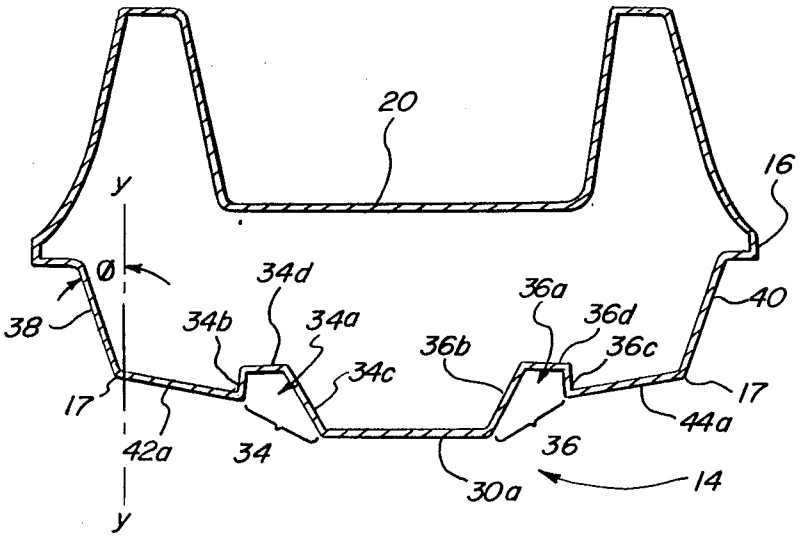
FIG. 8 is a cross sectional view taken along lines 8—8 of FIG. 5.

As discussed previously the concave sections 34 and 36 define channels or tunnels 34*a* and 36*a*. The sides 34*b*, 34*c*, 36*b* and 36*c* of the tunnels are straight except for the side formed by the curved portion 30*b* of the central section 30 adjacent the bow. The depth of the channels 34*a* and 36*a* increase as the channels extend from the bow to the stern. The average depth and width (designated d and w, respectively, in FIG. 9) of each channel adjacent the stern is within the range of about 2 to 3½ inches and preferably about 2½ inches. The channel depth d is measured from the middle of the upper surface (e.g. 34*d*), to a line connecting the lower edges of the channel sides (e.g. 34*b*, 34*c*) as is illustrated in FIG. 9. The average width w is measured between the sides (e.g. 36*b* and 36*c*) adjacent the lower edge of the shorter side as is shown in FIG. 9.

The sides of the concave sections 34 and 36 which form the channels act as stabilizing surfaces and substantially prevent the hull from skidding during high speed turns and cornering. The inner sides 34*c* and 36*b* of the channels slope inwardly toward the center section as shown while the outer sides 34*b* and 36*c* are about vertical adjacent the stern. See FIGS. 8 and 9.

The ride plate portion 30*d* of the central section 30 defines a pair of spaced downwardly protruding wings 50 and 52 which also act as stabilizers during turns. The jet pump exhausts the high velocity water within an opening in the stern 22 formed by the ride plate 30*d* and a bracket member 54. See FIG. 9.

The jet ski of my invention is about 30 inches wide from one peripheral edge to the other adjacent the stern and about 93 inches long.

A jet ski hull constructed in accordance with this invention is stable allowing the rider to stand up at low and high speeds. The jet ski tends to ride substantially level in water with minimum water spray reaching the rider. The ski has superior turning and cornering capability. Various modifications of the preferred embodiment as described above will be apparent to those skilled in the art without departing from the scope and spirit of my invention set forth in the appended claims.

What is claimed is:

1. In a jet-ski hull arranged symmetrically with respect to a longitudinal axis and having a bow and stern and upper and lower sections joined along a peripheral edge, the peripheral edge being arranged to extend above the nominal water line, the improvement in the lower section comprising:

(a) a central section extending from the bow to stern, the central section defining a water inlet opening intermediate the bow and the stern and a ride plate aft of the water opening, the ride plate including a pair of spaced downwardly protruding wings adjacent the concave sections for stabilizing the ski in turns, the central section being substantially flat from the stern to approximately three-fourths the distance to the bow;

(b) a concave section disposed on each side of the central section and extending substantially the length of the hull, each concave section forming a channel for directing water therethrough to aid in preventing the hull from skidding during turns, the channels generally increasing in depth from bow to the stern and being formed by substantially straight sides, each of the channels having an average depth within the range of 2 to 3½ inches and an average width within the range of 2 to 3½ inches adjacent the stern;

(c) a pair of side walls joined to the upper section at the peripheral edge and extending substantially the length of the hull, the side walls extending downwardly and inwardly from the peripheral edge toward the central section, each side wall adjacent the stern forming an angle of within the range of 10 to 30 degrees with a vertical plane passing through the peripheral edge; and (d) a transition section joining the lower portion of each side wall to a respective concave section, each of the transition sections being substantially flat and stepping upwardly approximately halfway between the bow and stern, so that the portion of the transition section adjacent the stern is in a plane above the remainder of the transition section.

2. The invention of claim 1 wherein the central section is approximately semi-cylindrical in shape forward of the flat section.

3. The invention of claim 2 wherein the angle that the side walls form with the vertical plane is about 20 degrees.

4. The invention of claim 3 wherein the transition sections form an angle and with a vertical plane within the range of about 60 to 80 degrees.

5. The invention of claim 4 wherein the angle that the transition sections form with a vertical plane is approximately 75 degrees.

6. The invention of claim 5 wherein the peripheral edge forms an angle of about 45 degrees at the bow.

7. In a jet-ski hull arranged symmetrically with respect to a longitudinal axis and having a bow and stern and upper and lower sections joined along a peripheral edge, the peripheral edge being arranged to extend above the nominal water line, the improvement in the lower section comprising:

(a) a central section extending from the bow to stern, the central section defining a water inlet opening intermediate the bow and the stern and a ride plate aft of the water opening, the ride plate including a pair of spaced downwardly protruding wings adjacent the concave sections for stabilizing the ski in turns, the central section being substantially flat from the stern to approximately three-fourths the distance to the bow end and approximately semi-cylindrical in shape forward of the flat section;

(b) a concave section disposed on each side of the central section and extending substantially the length of the hull, each concave section forming a channel for directing water therethrough to aid in preventing the hull from skidding during turns, the channels generally increasing in depth from bow to the stern and being formed by substantially straight sides, each of the channels having an average depth and width within the range of 2 to 3½ inches adjacent the stern;

(c) a pair of side walls joined to the upper section at the peripheral edge and extending substantially the length of the hull, the side walls extending downwardly and inwardly from the peripheral edge toward the central section, each side wall adjacent the stern forming an angle within the range of 10 to 30 degrees with a vertical plane passing through the peripheral edge; and (d) a transition section joining the lower portion of each side wall to a respective concave section.

8. The invention of claim 7 wherein the angle that the side walls form with the vertical plane is about 20 degrees.

9. The invention of claim 7 wherein the transition sections are substantially flat and slope downwardly and inwardly from the lower edge of the side panels.

10. The invention of claim 9 wherein the transition sections form an angle and with a vertical plane within the range of about 60 to 80 degrees.

11. The invention of claim 10 wherein the angle that the transition sections form with a vertical plane is approximately 75 degrees.

12. The invention of claim 11 wherein the peripheral edge forms an angel of about 45 degrees at the bow.

13. In a water craft hull arranged symmetrically with respect to a longitudinal axis and having a bow and stern and upper and lower sections joined along a peripheral edge, the peripheral edge being arranged to extend above the nominal water line, the lower section including:

(a) a central section extending from the bow to stern, the central section defining a water inlet opening intermediate the bow and the stern and a ride plate aft of the water opening;

(b) a concave section disposed on each side of the central section and extending substantially the length of the hull, each concave section forming a channel for directing water therethrough to aid in preventing the hull from skidding during turns, the channels generally increasing in depth from bow to the stern and being formed by substantially straight sides, each of the channels having an average depth within the range of 2 to 3½ inches and an average width within the range of 2 to 3½ inches adjacent the stern;

(c) a pair of side walls joined to the upper section at the peripheral edge and extending substantially the length of the hull, the side walls extending downwardly and inwardly from the peripheral edge toward the central section, each side wall adjacent the stern forming an angle within the range of 10 to 30 degrees with a vertical plane passing through the peripheral edge;

(d) a substantially flat transition section joining the lower portion of each side wall to a respective concave section, the transition sections sloping downwardly and inwardly from the lower edge of the side walls; and (e) each of said transition sections being substantially flat and stepping upwardly approximately halfway between the bow and stern, so that, in an upright position of the hull, the portion of the transition section adjacent the stern is in a plane above the remainder of the transition section.

14. In a water craft hull arranged symmetrically with respect to a longitudinal axis and having a bow and stern and upper and lower sections joined along a peripheral edge, the peripheral edge being arranged to extend above the nominal water line, the lower section including:

(a) a central section extending from the bow to stern, the central section defining a water inlet opening intermediate the bow and the stern and a ride plate aft of the water opening;

(b) a concave section disposed on each side of the central section and extending substantially the length of the hull, each concave section forming a channel for directing water therethrough to aid in preventing the hull from skidding during turns, the channels generally increasing in depth from bow to the stern and being formed by substantially straight sides, each of the channels having an average depth within the range of 2 to 3½ inches and an average width within the range of 2 to 3½ inches adjacent the stern;

(c) a pair of side walls joined to the upper section at the peripheral edge and extending substantially the length of the hull, the side walls extending downwardly and inwardly from the peripheral edge toward the central section, each side wall adjacent the stern forming an angle within the range of 10 to 30 degrees with a vertical plane passing through the peripheral edge;

(d) a substantially flat transition section joining the lower portion of each side wall to a respective concave section, the transition sections sloping downwardly and inwardly from the lower edge of the side walls; and (e) said central section being approximately semicylindrical in shape forward of said flat section.

15. The inventions of claim 14 wherein the transition sections form an angle and with a vertical plane within the range of about 60 to 80 degrees.

16. The invention of claim 15 wherein the angle that the transition section form with a vertical plane is approximately 75 degrees.

17. The invention of claim 14 wherein the peripheral edge forms an angle of about 45 degrees at the bow.

18. In a water craft hull arranged symmetrically with respect to a longitudinal axis and having a bow and stern and upper and lower sections joined along a peripheral edge, the peripheral edge being arranged to extend above the nominal water line, the lower section including:

(a) a central section extending from the bow to stern, the central section defining a water inlet opening intermediate the bow and the stern and a ride plate aft of the water opening;

(b) a concave section disposed on each side of the central section and extending substantially the length of the hull, each concave section forming a channel for directing water therethrough to aid in preventing the hull from skidding during turns, the channels generally increasing in depth from bow to the stern and being formed by substantially straight sides, each of the channels having an average depth within the range of 2 to 3½ inches and an average width within the range of 2 to 3½ inches adjacent the stern;

(c) a pair of side walls joined to the upper section at the peripheral edge and extending substantially the length of the hull, the side walls extending downwardly and inwardly from the peripheral edge toward the central section, each side wall adjacent the stern forming an angle within the range of 10 to 30 degrees with a vertical plane passing through the periperal edge;

(d) a substantially flat transition section joining the lower portion of each side wall to a respective concave section, the transition sections sloping downwardly and inwardly from the lower edge of the side walls; and (e) said channels having, adjacent said stern, approximately equal depth and width.

19. The invention of claim 18 wherein the average depth and width of the channels adjacent the stern is approximately $2\frac{1}{2}$ inches.

* * * * *

UNITED STATES PATENT AND TRADEMARK OFFICE

CERTIFICATE OF CORRECTION

PATENT NO. : 4,932,347

DATED : June 12, 1990

INVENTOR(S) : Albert A. Mardikian

It is certified that error appears in the above-identified patent and that said Letters Patent is hereby corrected as shown below: ON TITLE PAGE:

Abstract, line 3, "waterline" should read --water line--.

Column 1, line 43, after "have" should be --a--.

Column 3, line 12 "ξ" should read --£--.

Column 3, line 16, "ξ" should read --£--.

Column 6, line 41, "section" should be --sections--.

Column 3, line 14, "ξ" should read --£--.

Signed and Sealed this

Tenth Day of September, 1991

*Attest:*

*Attesting Officer*

HARRY F. MANBECK, JR.

*Commissioner of Patents and Trademarks*